US005588884A

United States Patent [19]

Rudoy et al.

[11] Patent Number: 5,588,884

[45] Date of Patent: Dec. 31, 1996

[54] STAMPED AND FORMED CONTACTS FOR A POWER CONNECTOR

[75] Inventors: Edward Rudoy, Woodland Hills; John S. Szalay, Corona Del Mar, both of Calif.

[73] Assignee: Packard Hughes Interconnect Company, Irvine, Calif.

[21] Appl. No.: 525,469

[22] Filed: Sep. 8, 1995

[51] Int. Cl.[6] ..... H01R 13/187

[52] U.S. Cl. ..... 439/845; 439/787

[58] Field of Search ..... 439/909, 787, 439/845, 927, 909.1

[56] References Cited

U.S. PATENT DOCUMENTS

| | | | |
|---|---|---|---|
| 2,877,442 | 3/1959 | Gettig | 439/787 X |
| 3,636,505 | 1/1972 | Poltonavage | 439/787 OR |
| 5,180,379 | 1/1993 | Drake et al. | 439/909 X |
| 5,322,458 | 6/1994 | Hennemann et al. | 439/787 X |
| 5,411,419 | 5/1995 | Ochi | 439/787 OR |

*Primary Examiner*—Gary F. Paumen
*Assistant Examiner*—Daniel Wittels
*Attorney, Agent, or Firm*—Cary W. Brooks

[57] ABSTRACT

A power connector system according to the present invention includes a pin contact having two blades that are located parallel and opposed to each other and attached to each other by an U-shaped bridge. A socket contact is provided having two U-shaped cavities for receiving respectively the two blades. The U-shaped cavities may be formed by a single piece of material formed in a S or W shape or other shapes producing U-shaped cavities. A spring member is received within each U-shaped cavity of the socket connector to provide a frictional fit when the blade is received in the spring member. The pin connector, socket connector and spring member may be stamped and formed from a flat conductive material.

4 Claims, 3 Drawing Sheets

STAMPED AND FORMED CONTACTS FOR A POWER CONNECTOR

FIELD OF THE INVENTION

This invention relates to power connectors, and more particularly to the design and manufacture of contacts for power connectors.

BACKGROUND OF THE INVENTION

Most existing power contacts that have been utilized in connectors are produced by a machining process because the contacts are made of a solid brass rod. Machining contacts increases the cost and complicates automation and mass production of power connectors.

The present invention provides advantages over the prior art.

SUMMARY OF THE INVENTION

A power connector system according to the present invention includes a pin contact having two blades that are located parallel and opposed to each other and attached to each other by an U-shaped bridge. A socket contact is provided having two U-shaped cavities, each for receiving one of the two blades. The U-shaped cavities may be formed by a single piece of material formed in a S or W shape or other shapes that U-shaped cavities. A spring member is received within each U-shaped cavity of the socket connector to provide a frictional fit when the blade is received in the cavity and spring member. The pin connector, socket connector and spring member each may be stamped and formed from a single piece of flat electrically conductive material.

These and other objects, features and advantages of the present invention will become apparent from the following brief description of the drawings, detailed description and appended claims and drawings.

BRIEF DESCRIPTION DRAWINGS

DETAILED DESCRIPTION

Figure 1:
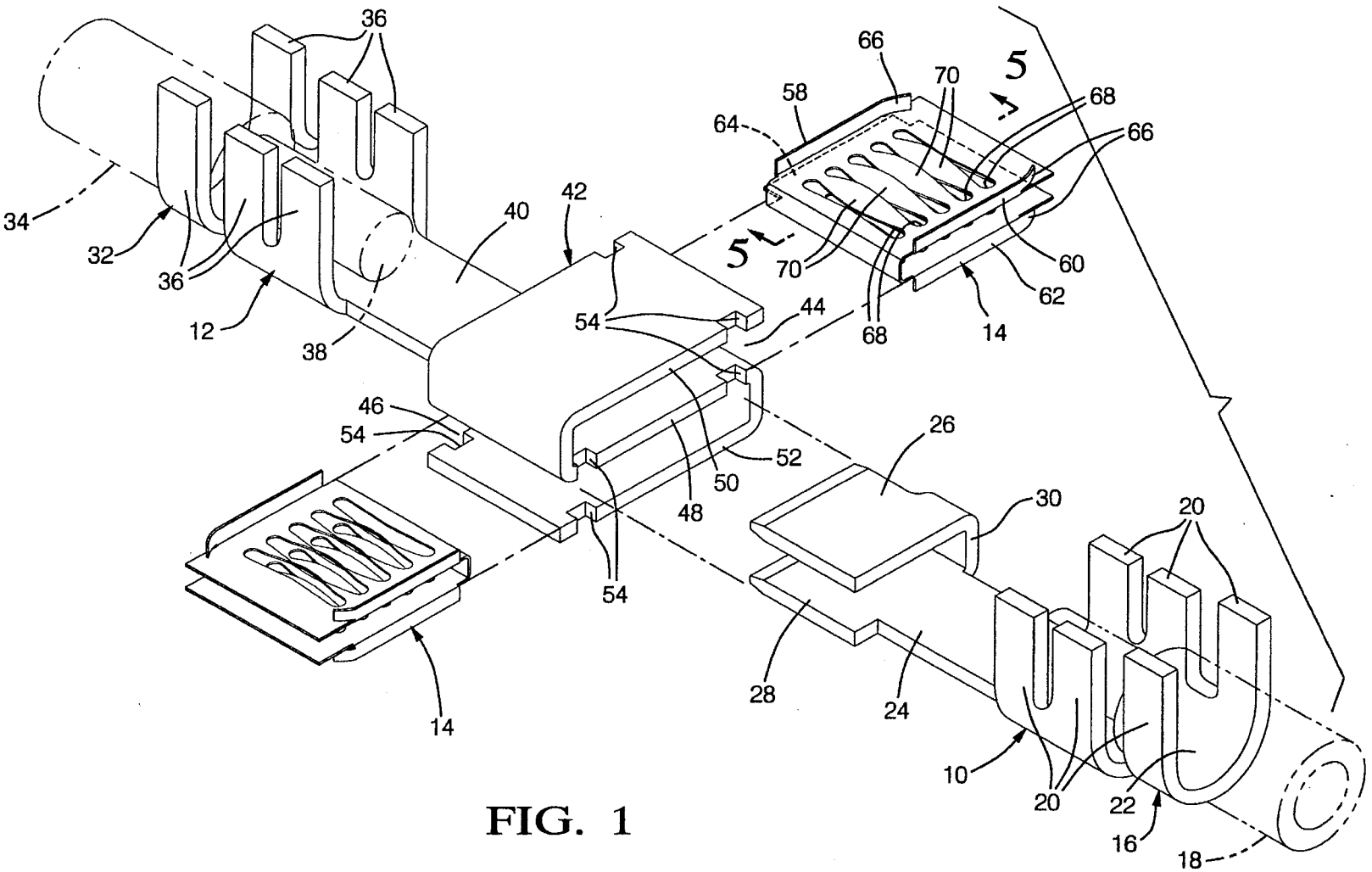
FIG. 1 illustrates a power connector according to the present invention including a pin contact, a socket contact and a spring member.

FIG. 1 illustrates a power connector according to the present invention including a pin contact 10, a socket contact 12 and spring members 14 received in the socket contact 12. The pin contact 10 is made from a single piece of stamped flat electrically conductive material and includes a termination end 16 for attachment to a wire 18. As shown in FIG. 1, the termination end 16 has a "F" crimp provided by a plurality of outwardly extending fingers 20 from a rectangular-shaped portion 22. The terminal end 16 may be designed to accommodate a variety of attachments such as a solderless wire crimp, bus bar, solder, etc., for attachment to a wire 18 or cable. A transition section 24 extends from the terminal end and preferably has a rectangular shape that allows forming of the contact to the right angle for the "right angle" wire dressing, avoiding bending in the wire as commonly occurs in existing connectors of the prior art. "Right angle" wire dressing means that the cable is soldered and crimped into the contact crimp barrel and bent to a sharp ninety degree angle away from the center line of the contact. The pin contact has two blades 26, 28 extending from the transition section 24 and connected together by a U-shaped bridge 30.

The socket contact 12 is made from a single piece of stamped flat electrically conductive material and also has a termination end 32 for connection to a wire 34 or cable. The termination end of the socket contact may be of a variety of shapes as described for the termination end of the pin contact. As shown in FIG. 1, again the termination end for the socket contact has a "F" crimp shape formed by a plurality of outwardly extending fingers 36 extending from a rectangular-shaped head portion 38. The socket contact also has a transition section 40 which preferably has a rectangular shape as for the pin contact. Extending from the transition section 40 is a socket component 42. The socket component has defined therein two U-shaped cavities 44 and 46. As shown in FIG. 1, the U-shaped cavities are defined by a S-shaped socket component 42. The S-shaped socket component 42 includes a body portion 48 and two arms 50 and 52 which extend outwardly in opposite directions from the body portion 48 of socket component. Notches 54 are formed in each arm 50 and 52 on both edges of the arm and at respective outer ends and a single notch 54 on the edge of body portion 48.

The spring members 14 are each made from a single piece of conductive material with good spring characteristics. The spring member is formed into a U shape with three tabs 58, 60, 62, extending outwardly and perpendicular to the general surface of the spring member for retention inside one of the contact cavities 44, 46 and one tab 64 that lies parallel to the general surface. Each of the perpendicular tabs has a foot 66 extending out from one end of the tab with a foot being free on three sides. Each foot 66 is bent to lock into a respective notch 54 formed in the arms 50, 52 and body portion 48 of the socket component 42 when the spring member 14 is placed in one of the cavities 44, 46. The spring member 14 has a plurality of cut-out windows 68 at a plurality of webs or strips 70 wherein a strip 70 separates adjacent windows 68. Each strip is connected to a flat base portion 72 of the spring member. The strip is twisted at an angle to the flat base portion 72 so that a portion of the strip extends outwardly from the flat base portion 72. The strips 70 extending outwardly from the flat base portion 72 of the spring member provides electrical contact between the pin and socket connectors.

Figure 2:
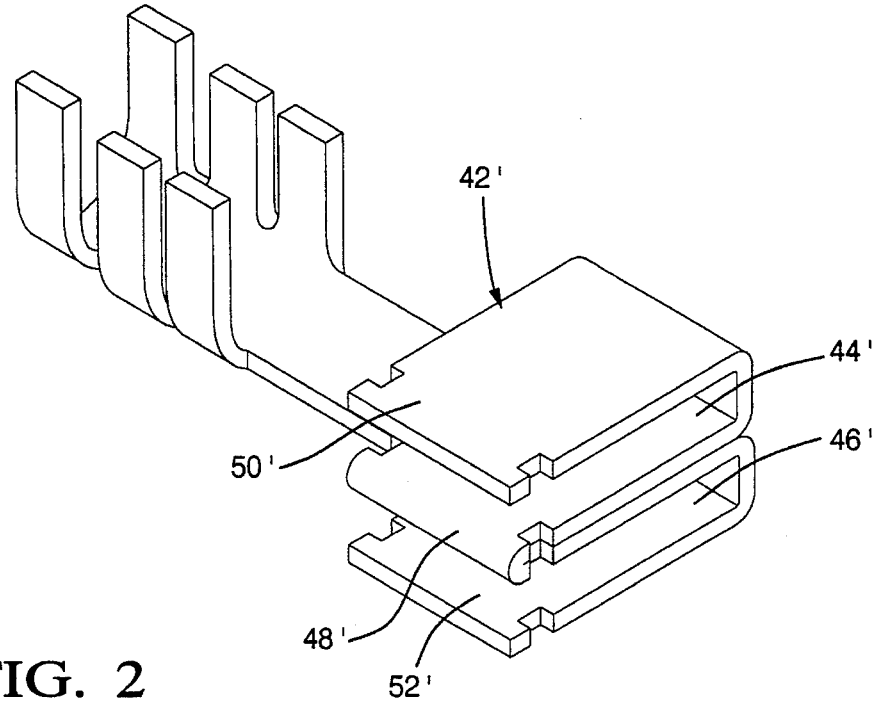
FIG. 2 illustrates an alternative configuration of a socket component according to the present invention.

FIG. 2 shows an alternative form of a socket component 42' wherein the body portion 48' of the socket component is folded one way and the arms 50', 52' are folded in another way to provide a W-shaped socket component having two cavities 44', 46' defined therein.

Figure 3:
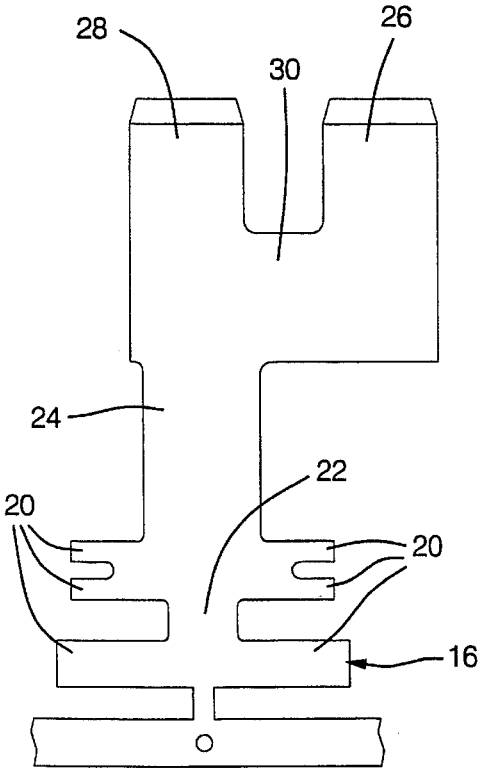
FIG. 3 illustrates a stamped flat piece of material from which a pin connector according to the present invention may be formed.
Figure 4:
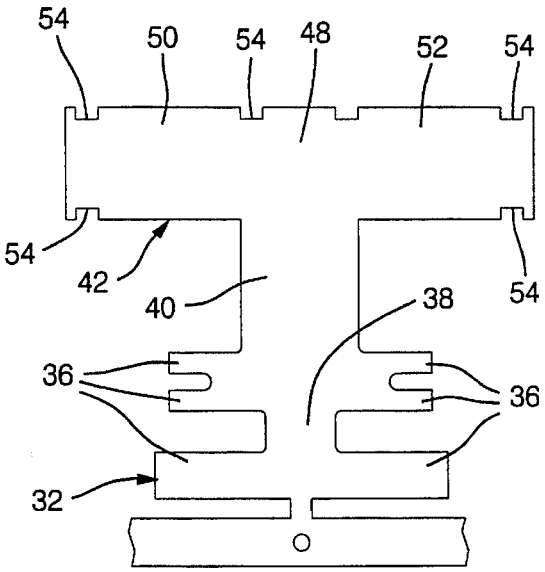
FIG. 4 illustrates a stamped flat piece of material from which a socket contact of FIG. 1 according to the present invention may be formed.

FIG. 3 illustrates a stamped flat single piece of electrically conductive material in a design from which the pin connector according to the present invention is formed. FIG. 4 illustrates a stamped flat single piece of electrically conductive material from which a socket connector 42 of FIG. 1 according to the present invention is formed.

Figure 6:
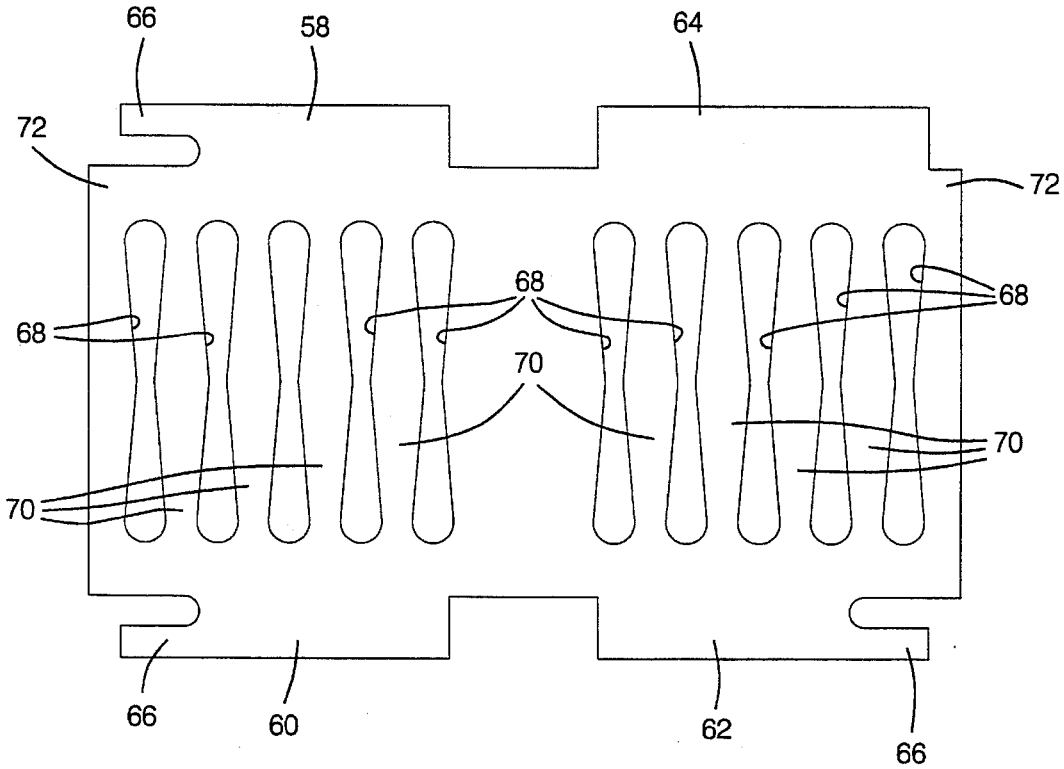
FIG. 6 illustrates a stamped flat piece of material from which a spring member according to the present invention may be formed.

FIG. 6 illustrates a stamped flat single piece of electrically conductive material from which a spring member according to the present invention is formed.

Figure 5:
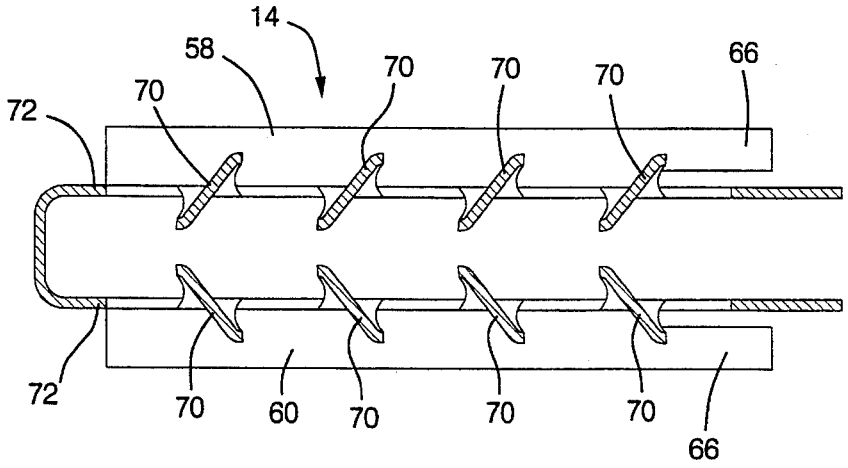
FIGS. 5 illustrates a sectional view of a spring member as seen along a plane indicated by line 5—5 in FIG. 1 according to the present invention.

FIG. 5 is a side sectional view of a spring member according to the present invention having strips 70 formed at an angle to a flat base portion 72 of the spring member 14.

What is claimed is:

1. A power connector system comprising:

a pin contact, a socket contact and a spring member;

said pin contact comprising a termination end for attachment to a wire, a transition section extending from the termination end, and two blades extending from the transition section and wherein said blades are connected by a U-shaped bridge;

a socket contact having a termination end for attachment to a wire, a transition section extending from the termination end, and a socket component connected to the transition section, said socket component having a body portion and two arms extending outward in opposite directions therefrom, each arm having a pair of opposed notches formed near one end of the arm and a pair of opposed notches formed near the other end of the arm, said body and arms being constructed and arranged to define two U-shaped cavities;

a U-shaped spring member received in each of said cavities and constructed and arranged to provide a frictional fit when said blades are inserted into the respective cavities.

2. A power connector system as set forth in claim 1 wherein said spring member comprises a flat base portion having a plurality of windows formed in the flat base portion, wherein adjacent windows are separated by a strip having ends extending from the flat base portion, said strip being twisted at an angle to the surface of the flat base portion, and tabs extending outward from the flat base portion, wherein each tab has a foot which is free on three sides, said foot being bent to engage an associated notch formed in said arm and to lock the spring member in a cavity defined in the pin connector.

3. A power connector system as set forth in claim 1 wherein said arms of the socket component are bent in opposite directions to provide an S-shaped socket component.

4. A power connector system as set forth in claim 1 wherein the body portion of the socket component is bent in one direction and the arms are bent in the other direction to provide a W-shaped socket component.

* * * * *